US007455178B2

(12) United States Patent
Miller, Jr.

(10) Patent No.: US 7,455,178 B2
(45) Date of Patent: Nov. 25, 2008

(54) POLE VAULT POLE CARRYING CASE

(76) Inventor: Elwood Bernard Miller, Jr., 2766 Ariane Dr., #82, San Diego, CA (US) 92117

( * ) Notice: Subject to any disclaimer, the term of this patent is extended or adjusted under 35 U.S.C. 154(b) by 511 days.

(21) Appl. No.: 11/184,465

(22) Filed: Jul. 19, 2005

(65) Prior Publication Data

US 2007/0017835 A1 Jan. 25, 2007

(51) Int. Cl.
*B65D 85/20* (2006.01)

(52) U.S. Cl. ..... 206/315.1; 206/443; 206/579; 190/125

(58) Field of Classification Search ..... 206/315.1, 206/443, 315.11, 576, 579, 315.2, 315.6; 190/124, 125, 127; 150/154
See application file for complete search history.

(56) References Cited

U.S. PATENT DOCUMENTS 1,442,906 A * 1/1923 Rawlings et al. ..... 206/315.4
1,920,308 A * 8/1933 Hiles ..... 206/315.6
2,010,166 A * 8/1935 Thompson ..... 206/315.6
2,023,792 A * 12/1935 Sampson ..... 206/315.4
3,295,643 A * 1/1967 Peterson et al. ..... 190/119
4,182,391 A * 1/1980 Kjose ..... 224/581
4,227,559 A * 10/1980 Stroman ..... 206/315.6
4,420,024 A * 12/1983 Clayton ..... 206/315.4
4,793,532 A * 12/1988 Cash ..... 224/584
5,219,075 A * 6/1993 White ..... 206/314
5,327,669 A * 7/1994 Lannan et al. ..... 43/26
5,423,404 A * 6/1995 Shaw ..... 190/102
6,250,470 B1 * 6/2001 Mackenzie ..... 206/579
6,513,661 B1 * 2/2003 Mogil ..... 206/579
6,629,601 B1 * 10/2003 Russell ..... 206/315.3
6,966,439 B2 * 11/2005 Weleczki ..... 206/315.3

* cited by examiner

*Primary Examiner*—David T Fidei
(74) *Attorney, Agent, or Firm*—Greer, Burns & Crain, Ltd.

(57) ABSTRACT

A case for carrying pole vault poles is made of an elongate flexible bag of a length approximately equal to the length of the pole vault pole or poles to be carried and a sheet of semi-rigid laterally bendable material generally coextensive with the bag and forming therewith a shell for protectively encircling the pole or poles contained within the bag. The bag is preferably of butterfly style foldable and unfoldable about a longitudinal fold line between a closed position and an open position. The sheet of semi-rigid material lies flat in the open position of the bag and is bendable about the longitudinal fold line to form a pole encircling protective shell in the closed position of the bag. The case facilitates convenient carrying of pole vault poles from place to place, for example, from track meet to track meet, and insures safe, damage free transport of pole vault poles when transported, for example, via commercial carriers.

6 Claims, 2 Drawing Sheets

POLE VAULT POLE CARRYING CASE

FIELD OF THE INVENTION

The present invention relates to bags and cases for carrying athletic gear, and particularly to cases for storing and carrying pole vault poles.

BACKGROUND OF THE INVENTION

Pole vaulting poles are typically 13 to 17 feet long, formed of fiberglass and/or graphite fibers, and priced up to $500 and more. Each pole is individual to a particular vaulter, i.e., to that vaulter's height, weight, physical characteristics and vaulting style.

A pole vaulter typically has several vaulting poles, and a team of pole vaulters will customarily have a large number of poles. Since the poles are individualized to individual vaulters they need to be transported from track meet to track meet, frequently by commercial carriers, and for long distances and overseas travel, by commercial airlines. Commercial airlines are not known for exercising care in the handling of baggage.

The poles are quite precious to the vaulter, in terms both of initial cost and performance at a meet, and the vaulter does not want the poles to incur any damage, abuse or mishandling.

There is, therefore, a need for a product in which pole vaulting poles can be safely stored and transported from place to place. Wooden and rigid plastic boxes or the like could, of course, be used, but wooden boxes and the like are heavy, unwieldy and out of place at a track meet. Canvas bags and slings are fine for use at a meet, to carry the poles from a dressing room to a vaulting site, but are not capable of providing effective protection for the poles during transport, especially transport via commercial carriers.

SUMMARY OF THE INVENTION

The object of the present invention is to provide a pole vault pole carrying case that is lightweight, economical, convenient to use, e.g., for carrying poles from place to place, especially at track meets, and that is effective to protect poles from damage or mishandling during transport, especially commercial and air transport.

In accordance with the invention, a pole vault pole carrying case is comprised of an elongate bag, somewhat longer than the longest pole to be carried, made of lightweight, flexible, wear and abuse resistant material, and a thin lightweight sheet of a semi-rigid reinforcing material generally coextensive with the bag and capable of forming with the bag an essentially rigid protective shell about poles contained within the bag.

The bag may be made of the materials customarily used in the manufacturer of soft side luggage, such as tough, wear, weather and abuse resistant nylon. The bag is preferably of butterfly design, i.e., adapted to be folded and unfolded along a longitudinal center line between closed and open positions, and with one or more zippers or other closures along its free edges for securing the bag in closed position.

The thin sheet of semi-rigid material may, for example, comprise a plastic, such as low density polyethylene, which in thin sheet form is laterally bendable to accommodate folding of a butterfly style bag between its open and closed positions. The sheet may also be longitudinally bendable, i.e., it may but need not be longitudinally rigid, since the pole or poles contained in the bag will maintain longitudinally integrity. The important factors in the selection of the plastic sheet are the abilities to bend into a pole encircling, essentially rigid shell for protecting the poles in the closed position of the bag.

The pole carrying case of the invention also preferably includes liner material forming a plurality of longitudinally extending tubular pockets for receiving individual poles and protecting them from direct contact with other poles. The case also preferably includes hand and shoulder carrying straps for convenience in carrying a plurality of poles from place to place.

The invention thus provides a lightweight, easily transportable, essentially rigid case for conveniently storing and carrying pole vault poles and for effectively protecting the poles from abuse, mishandling and damage during transport.

These and other objects and advantages of the invention will become apparent to those of reasonable skill in the art from the following detailed description, as considered in conjunction with the accompanying drawings.

DETAILED DESCRIPTION OF PREFERRED EMBODIMENT

The following is a detailed description of one embodiment of the invention presently deemed by the inventor to be the best mode of carrying out his invention.

Figure 1:
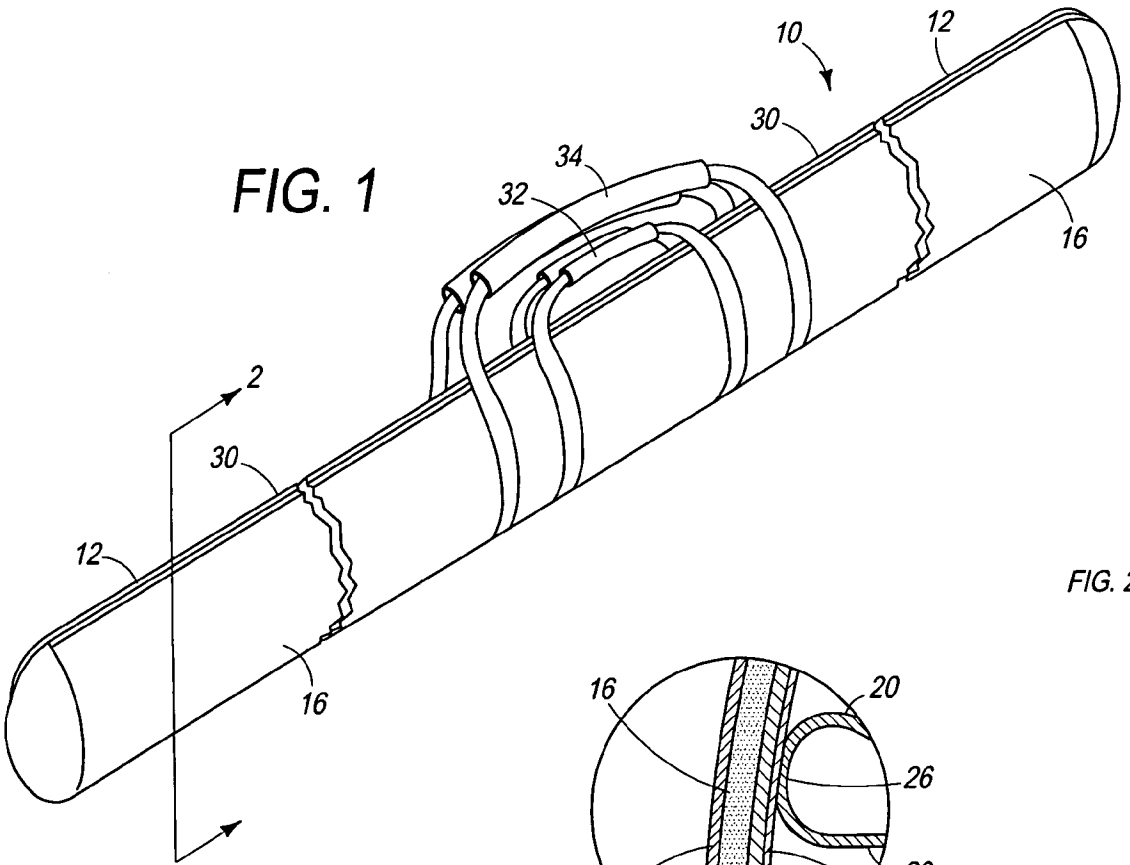
FIG. 1 is a perspective view of a preferred embodiment of the pole vault pole carrying case of the invention illustrating the same in closed position.
Figure 3:
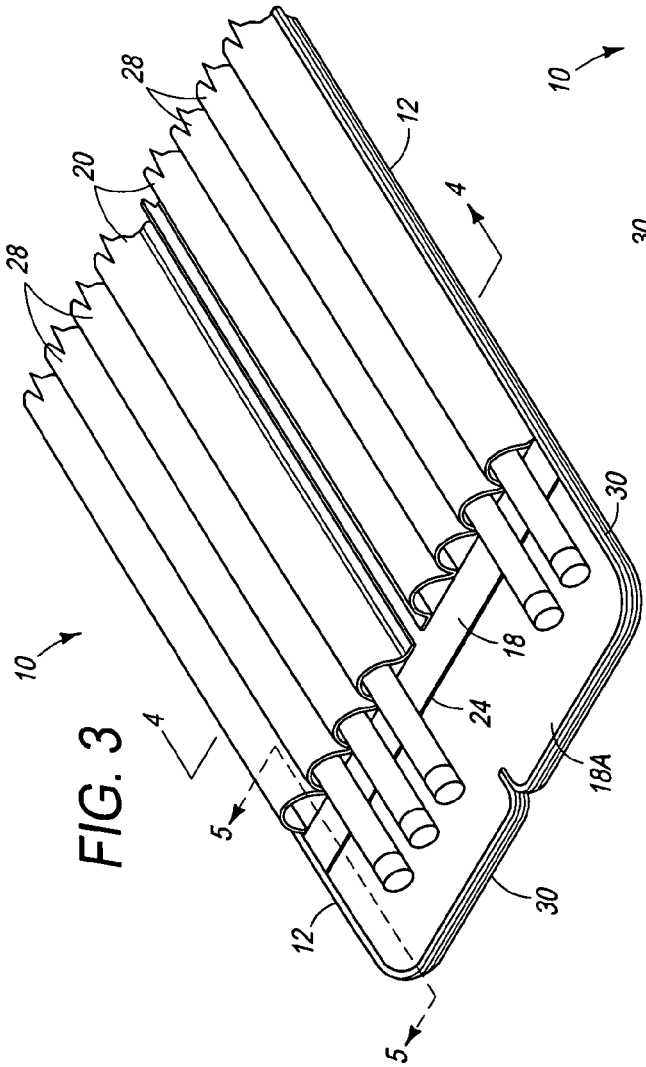
FIG. 3 is a fragmentary perspective view of the carrying case of FIG. 1 illustrating the same in open position and with pole vault poles therein.
Figure 4:
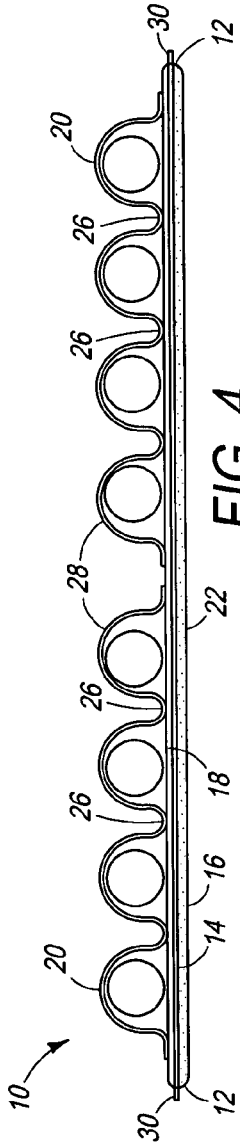
FIG. 4 is a cross sectional view taken along line 4-4 of FIG. 3.

Referring to the drawings, a pole vault pole carrying case 10 provided in accord with the invention is preferably of a butterfly style or design foldable and unfoldable about a line, preferably a longitudinal center line, between a closed position illustrated in FIG. 1 and an open position illustrated in FIG. 3.

The case 10 is of a length approximately equal to and preferably somewhat greater than that of the pole or poles to be carried and is preferably of a width sufficient to receive and accommodate a plurality of poles. In the illustrated embodiment, the case is sized to carry eight poles, but the number of poles accommodated may be of substantially any reasonable number.

The case 10 is comprised of a lightweight, flexible soft goods bag 12 and a thin, complementary sheet 14 of a semi-rigid material, i.e., a material such as low density polyethylene, that is dimensionally stable but readily bendable.

The bag 12 in its open position is essentially rectangular, having the width and length dimensions above described. The bag is preferably comprised of an outer ply 16 of a durable wear, weather and abuse resistant fabric, such as canvas or nylon or other suitable natural or synthetic material, and two plies 18 and 20 of a wear resistant liner material, such as a lightweight nylon. Generally, the materials of construction and their mode of assembly into the bag 12 may be the same as or comparable to those employed in the manufacturer of soft side luggage.

The outer ply 16 of the bag preferably includes a layer of padding material 22, such as an integral layer of foam.

The outer ply 16 and the next adjacent ply 18 of liner are generally coextensive and secured together at all but one of their coextensive marginal edges, thereby leaving one edge 22 of the liner 18 unsecured or open. The open or unsecured edge of the liner 18 is preferably though not necessarily a width-wise edge.

The ply 20 of liner material is generally coextensive with but is preferably of a length less than and of a width greater than the liner ply 18. The ply 20 is folded and stitched or otherwise secured at spaced longitudinal seams 26 to the liner 18 thereby to form a plurality of parallel longitudinal pockets 28 each adapted for reception of an individual pole, as is illustrated in FIGS. 3-6. In the illustrated embodiment of the invention, the liner 20 forms eight pole pockets 28, but as above noted the number of pockets is variable. It is preferred that no pole pocket 28 be located on the longitudinal center line of the bag so that the bag may be folded substantially unimpeded between its open and closed positions.

The ply 20 is initially stitched or otherwise secured to the ply 18 and the plies 18 and 20 are then stitched or otherwise secured to the outer ply 16 thereby to form the flexible bag 12. The outer ply 16 is preferably provided at its free marginal edges with closure means, such as cooperating zipper elements 30, for securing the bag in its closed position.

The sheet 14 of semi-rigid laterally bendable material is of a size generally coextensive with the outer ply 16 of the bag, but is slightly shorter than the ply 16 and slightly narrower than the plies 16 and 18. The sheet is thus slideably and removeably insertable via the open edge 24 of the liner 18 into the space between the liner 18 and the outer ply 16 to impart dimensional stability to the flexible bag 12. A liner flap 18A may if desired be provided to cover the end portion of the sheet 14 for aesthetic purposes.

Figure 2:
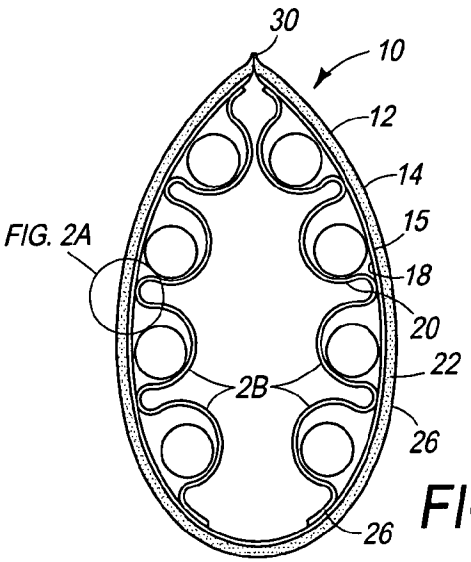
FIG. 2 is a cross sectional view of the carrying case of FIG. 1, taken along line 2-2 of FIG. 1, and illustrating the carrying case in closed position with pole vault poles therein.
Figure 2A:
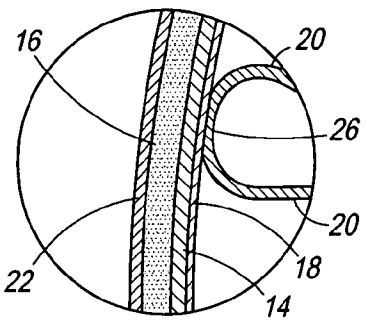
FIG. 2A is an enlarged cross section of the portion of the carrying case encircled in FIG. 2.
Figure 6:
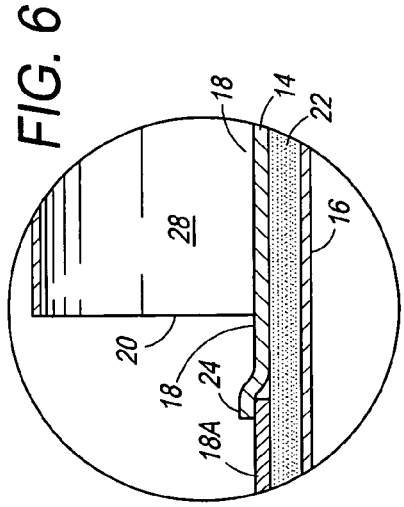
FIG. 6 is an enlarged cross section of the portion of the carrying case encircled in FIG. 5.
Figure 5:
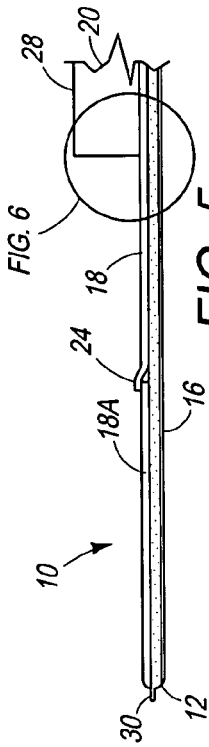
FIG. 5 is a fragmentary longitudinal section taken along line 5-5 of FIG. 3.

The semi-rigid sheet 14 lies flat in the open position of the case, as shown in FIG. 3, and is laterally bendable about a longitudinal line into a generally cylindrical, elliptical or egg or teardrop shape when the case is folded into its closed position, as shown in FIGS. 1 and 2.

In the closed position of the carrying case, the sheet 14, despite its thinness and bendability, provides a sturdy, shock and blow resistant protective shell encircling the pole vault poles and protecting the same against damage and/or abuse due to mishandling in transport. The case also provides a convenient and safe storage vessel for poles between practices and meets.

To facilitate carrying of contained poles, the bag 12 is preferably provided with both a hand carrying strap 32 and a shoulder carrying strap 34 secured to a central portion of the bag in the manner conventional for soft luggage. The straps, especially the shoulder strap 34, may be padded and/or adjustable for length, if desired.

The invention thus provides a lightweight, portable case for the safe storage and convenient transport of pole vault and like poles, which is highly effective in protecting the poles from mishandling, abuse and damage.

The objects and advantages of the invention have therefore been shown to be attained in a convenient, economical, practical and facile manner.

While a preferred embodiment of the invention has been herein illustrated and described, it is to be appreciated the various changes, rearrangements and modifications may be made therein without departing from the scope of the invention as defined by the appended claims.

What is claimed is:

1. A pole carrying case comprising an elongate flexible bag for receiving therein one or more poles, and a sheet of semi-rigid material generally coextensive with the bag and forming therewith a protective shell about a pole or poles contained within the bag, said bag being comprised of an outer ply of wear resistant material and an inner liner generally coextensive with said outer ply secured at all but one of its margins to corresponding margins of the outer ply, and said sheet of semi-rigid material being slideably inserted between said outer ply and said liner.

2. A carrying case as set forth in claim 1 wherein said bag is foldable and unfoldable about a longitudinal fold line between closed and open positions, said inner liner is folded longitudinally into one or more longitudinal pockets for receiving individual poles, and said sheet of semi-rigid material is laterally bendable about said fold line for enclosing and protecting a pole or poles contained within said bag.

3. A carrying case for pole vault and like poles comprising an elongate flexible bag of a length at least as long as the poles to be carried for receiving therein one or more poles, and a thin elongate sheet of semi-rigid material generally coextensive with the bag and forming therewith a protective shell for encircling a pole or poles contained with the bag, said bag being comprised of an outer ply of wear resistant material and an inner liner generally coextensive with said outer ply and secured at all but one of its margins to corresponding margins of the outer ply, and said sheet of semi-rigid material being slideably inserted between said outer ply and said liner.

4. A carrying case as set forth in claim 3 wherein said bag is of butterfly style foldable and unfoldable about a longitudinal fold line between closed and open positions and is folded longitudinally into one or more longitudinal pockets for receiving individual poles, and wherein said sheet of semi-rigid material is laterally bendable about said fold line for enclosing and protecting a pole or poles contained within said bag.

5. A pole vault pole carrying case comprising an elongate flexible bag of a length somewhat greater than that of poles to be carried for receiving therein one or more pole vault poles, said bag being foldable and unfoldable between closed and open position about a longitudinal center line and including closure means, said bag being comprised of an outer ply of wear and abuse resistant material and an inner liner generally coextensive with said outer ply secured at all but one of its margins to corresponding margins of said outer ply, said liner being folded and secured longitudinally into one or more longitudinal pockets for receiving individual poles, and a sheet of semi-rigid laterally bendable material generally coextensive with said bag slideably inserted between said outer ply and said liner, said sheet being laterally bendable about said longitudinal center line between the closed and open positions of said bag and in the closed position forming a protective shell encircling a pole or poles contained within said bag.

6. A carrying case as set forth in claim 5 including a hand strap and a shoulder strap secured to a mid-portion of said bag for carrying said bag and poles contained therein.

* * * * *